United States Patent [19]

Merkator et al.

[11] Patent Number: 4,573,621

[45] Date of Patent: Mar. 4, 1986

[54] ELECTRO-MAGNETIC TACKER

[75] Inventors: Manfred Merkator; Karl Schmid, both of Idstein, Fed. Rep. of Germany

[73] Assignee: Black & Decker Inc., Newark, Del.

[21] Appl. No.: 725,393

[22] Filed: Apr. 22, 1985

[51] Int. Cl.[4] ..... B25C 5/06; B25C 5/15; B27F 7/26; B27F 7/38

[52] U.S. Cl. ..... 227/8; 227/121; 227/125; 227/131

[58] Field of Search ..... 227/6, 8, 121, 125, 227/130, 131, 156

[56] References Cited

U.S. PATENT DOCUMENTS

| | | | |
|---|---|---|---|
| 400,792 | 4/1889 | Remus | 227/125 X |
| 3,041,614 | 7/1962 | D'Haem et al. | 227/125 X |
| 3,940,044 | 2/1976 | LaPointe | 227/125 X |
| 4,183,453 | 1/1980 | Barrett et al. | 227/131 |
| 4,375,867 | 3/1983 | Novak et al. | 227/131 X |

FOREIGN PATENT DOCUMENTS

| | | | |
|---|---|---|---|
| 1286469 | 1/1969 | Fed. Rep. of Germany | 227/8 |
| 2823284 | 4/1979 | Fed. Rep. of Germany | 227/131 |
| 3232137 | 6/1983 | Fed. Rep. of Germany | 227/131 |
| 1290830 | 3/1962 | France | 227/131 |
| 1028071 | 5/1966 | United Kingdom | 227/8 |
| 2117692 | 10/1983 | United Kingdom | 227/8 |

*Primary Examiner*—Paul A. Bell
*Assistant Examiner*—Taylor J. Ross
*Attorney, Agent, or Firm*—Edward D. Murphy; Harold Weinstein; Ronald B. Sherer

[57] ABSTRACT

An electro-magnetic tacker, which can carry out a limited number of driving strokes when its main switch is actuated, has a staple magazine pivotal between a blocking position and an operating position. In the operating position of the staple magazine, a staple blocking member blocks the front staple located in the staple magazine and, in the blocking position of the staple magazine, releases this staple for entry into a staple output channel. A coupling element connected to the staple magazine has an engagement portion which, in the switched-on position of an actuator element of the main switch, is in engagement with this. In this switched-on position, the actuator element holds the staple magazine in the operating position via the coupling element, so that the tacker can be lifted off from a workpiece, while at the same time the operating position of the staple magazine and the blocking action of the staple blocking member are maintained.

15 Claims, 2 Drawing Figures

ELECTRO-MAGNETIC TACKER

FIELD OF THE INVENTION

The invention relates to electro-magnetic tackers, particularly power-driven tackers which can carry out a limited number of driving strokes when the main switch is actuated.

BACKGROUND OF THE INVENTION

It is known in a power-driven tacker to mount the staple magazine to be movable between a blocking position and an operating position. In the blocking position, the magazine outlet end for the staples is pivoted downwards away from the tacker housing. In the operating position, the outlet end of the magazine is pivoted upwards into a position adjacent the tacker housing.

German Utility Model No. 8,303,460 discloses such an electro-magnetic tacker in which the actuator element of the main switch is connected to an elongate coupling element which extends downwards to just above the staple magazine. In the blocking position of the staple magazine, a blocking element fastened pivotably to the housing engages into a locking recess in the elongate coupling member. When the staple magazine is pivoted into the operating position, the blocking element pivots as a result, so that the coupling element is released and the actuator element can be displaced to actuate the main switch. The tacker carries out a driving stroke only when the staple magazine is in its operating position, that is to say when the outlet of the staple output channel is placed on a workpiece. The tacker is electronically controlled, and carries out a driving stroke whenever the actuator element is actuated. To execute a further driving stroke, the tacker has to be lifted off from the workpiece and replaced, whereupon a further staple is driven into the workpiece by means of the following driving stroke.

German Offenlegungsschrift No. 2,823,248 discloses a tacker which is controlled by electronics and which, when the main switch is actuated, carries out a specific number of driving strokes, but more than one stroke so that a staple or a nail can be driven even into a relatively hard workpiece. For this purpose, the actuator element of the main switch has coupled to it a staple blocking means which is displaced as a result of actuation of the actuator element, in such a way that it prevents the front staple or the front nail from subsequently being transferred from the staple magazine into the staple output channel. Thus, the driver strikes the same staple or the same nail several times, without further staples or nails being fed into the staple output channel. To start a new operating cycle, the actuator element of the main switch must be released, as a result of which the staple blocking means releases the front staple or the front nail from the staple magazine so that it then enters the staple output channel. When the actuator element is actuated again, a further sequence of driving strokes can be triggered.

French Patent Specification No. 1,290,830 discloses a tacker in which the number of driving strokes is controlled as a function of the driving depth which is reached. For this purpose, this tacker too has a staple blocking means which is connected to the actuator element of the main switch and which, during a cycle of driving strokes, prevents a staple or a nail from being conveyed out of the staple magazine into the staple output channel. When the main switch of the tacker supplied with direct-current voltage is closed, successive driving strokes are triggered. When the predetermined driving depth is reached, an angle fastened to the drive-solenoid armature connected firmly to the driver engages with a toggle lever mounted pivotably on the actuator element and pivots this toggle lever in such a way that the main switch is opened. It is possible to reclose the main switch by actuating the actuator element only after the latter has been released and thus, as a result of the release of the staple blocking means, a new staple or a new nail has been transported into the staple output channel.

SUMMARY OF THE INVENTION

It is observed, according to the invention, that when tackers are used, it can happen that a staple or nail to be driven in is still not driven into the workpiece completely after one or more driving strokes have been carried out, but this is noticed only after the tacker has been lifted off.

The object of the invention is to provide a tacker which can be replaced on a staple or nail not completely driven in, and can drive this staple or nail further into the workpiece.

Accordingly, there is provided by the present invention a power driven tacker which carries out a limited number of driving strokes upon actuation of its main switch, said tacker comprising a staple magazine mounted on the tacker housing and movable between a blocking position in which its output end for the staples is pivoted downwardly in relation to said tacker housing and an operating position in which its output end is pivoted into a position adjacent to said tacker housing, a coupling element located between said staple magazine and an actuator element for said main switch, said coupling element on the one hand being connected with said tacker magazine and on the other hand being provided with an engagement portion which is in engagement with said actuator element in the on position of said actuator element so that said tacker magazine is held in its operating position by means of said coupling element, and a staple blocking means which blocks feeding of the front staple in said staple magazine in the operating position of said staple magazine and which permits feeding of such front staple into the staple output channel in the blocking position of said staple magazine.

It should be noted, in this respect, that the term "staple" has been used only to simplify the description, but that this term refers to all fastening elements which can be conventionally driven into a workpiece by means of a tacker of this type, that is to say, for example U-shaped staples, nails, pins etc.

When the actuator element is held actuated, the staple magazine is held in its operating position by the coupling element, so that if the tacker is lifted off from the workpiece, the staple magazine will be held in its operating position by means of the actuator element. Since, in the operating position of the staple magazine with the actuator element actuated, the staple blocking means prevents staples from being conveyed out of the staple magazine into the staple output channel, the lifted-off tacker can, therefore, be replaced on a staple not completely driven in, since the staple blocking means prevents a new staple from entering the staple output channel. When the actuator element is released after the tacker has been replaced, so that the actuator element comes into its initial position to actuate the main switch again, the staple blocking means prevents a further staple from being fed into the staple output channel, since, as a result of the operating position of the staple magazine, it is held in its position blocking the supply of staples to the staple output channel.

If the tacker is lifted off from the workpiece and the actuator element is released, the staple magazine pivots into its blocking position in the usual way. The staple blocking means is inactivated and the next staple is therefore, conveyed out of the staple magazine into the staple output channel. This staple can then be driven into the workpiece in the usual way when the tacker is placed on a workpiece.

The staple blocking means may comprise a two-armed pivotably mounted lever which preferably has angled ends. One end of these ends engages with the staple magazine in the operating position of the latter, this so pivoting the lever that the other end is moved into blocking engagement with the front staple in the staple magazine. A pad element having a high coefficient of friction, for engagement with the staple to be blocked, is preferably mounted on the said other end of the lever. This staple blocking means is of simple construction and, simply as a result of the pivoting of the staple magazine into the operating position and the consequent engagement of the staple magazine with one arm of the lever, is brought into a position in which the other arm of the lever blocks the staple feed.

In a preferred embodiment of the invention, the coupling element consists of a bar element having an annular shoulder forming the engagement portion, and the actuator element has a projection which is located between the staple magazine and the annular shoulder and which can be engaged with the latter. Consequently, when the actuator element is actuated, its projection engages with the annular shoulder of the coupling element.

This bar element can have, at its end facing away from the staple magazine, an elastically movable blocking projection which, in the blocking position of the staple magazine, rests against a stationary stop surface so as to block the actuator element. In the operating position of the staple magazine, the blocking projection is flexed or pivoted out of the region of the stop surface.

Other objects, features and advantages of the present invention will become more fully apparent from the following detailed description of the preferred embodiment, the appended claims and the accompanying drawings.

DETAILED DESCRIPTION OF THE PREFERRED EMBODIMENTS

Figure 1:
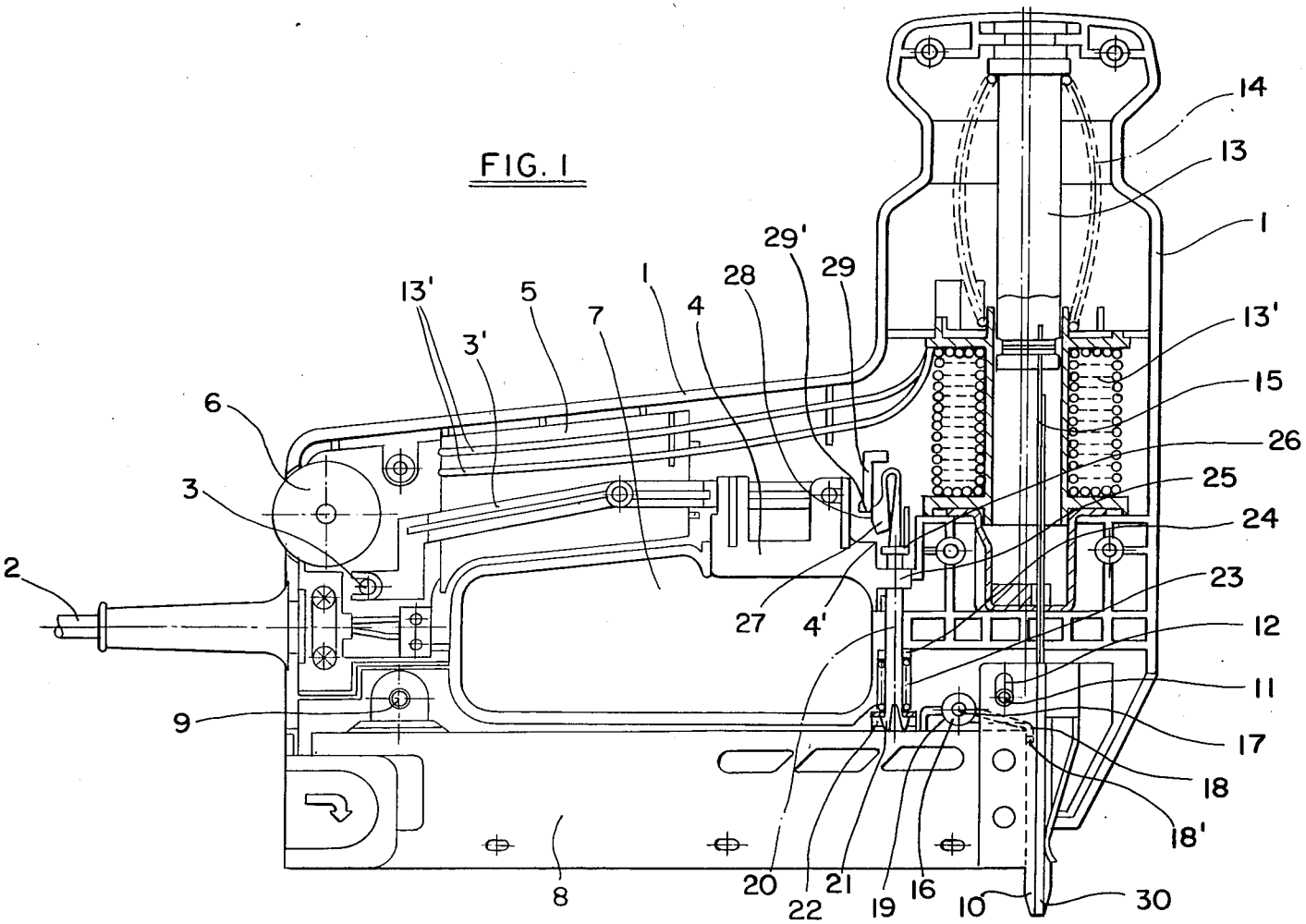
FIG. 1 shows diagrammatically a vertical section through a power driven tacker embodying the invention.

The electro-magnetic tacker illustrated in FIG. 1 has a conventional housing consisting of two half-shells, one of which is removed, so that the other half-shell 1 and the components which it receives can be seen.

The half-shell 1 contains a main switch 3 which is accommodated in a housing and to which a voltage supply cable 2 is connected, and control electronics 5 indicated only diagrammatically and controlled by means of a manually rotatable knob 6. A switch actuator element 4 extends into a hand-gripping orifice 7 of the housing and is coupled mechanically to the switch 3, as indicated at 3'.

Mounted on a pivot axle 9 in the lower part of the housing 1 is a staple magazine 8 of conventional design. At the end of the magazine 8 on the right in FIG. 1, a vertical slot 12 is provided through which extends a pin 11 retained in the housing. This enables the magazine 8 to pivot to a limited extent about the axle 9, specifically between the operating position shown in FIG. 1, in which the pin 11 rests against the lower limiting wall of the slot 12, and a blocking position in which the pin 11 contacts the upper limiting wall of the slot 12. The staple magazine forms, with its end on the right in FIG. 1 and with further parts provided in the housing, a staple output channel 30, into the top end of which extends a driving element 15. The driving element 15 is fastened to the armature 13 of a solenoid which interacts with an annular exciting coil 13' and which, in the non-excited state of the coil, is held by a barrel-shaped spring 14 in the raised position shown. The coil 13' is connected to the switch 3 by leads 13".

A two-armed bell crank lever 16, the ends of the two arms 18 and 19 of which are angled downwardly, is located adjacent the front end region of the staple magazine 8, and is pivoted on axle 17 mounted in the housing just above the front end of the staple magazine 8. A pad element 18' consisting of a material having a relatively high coefficient of friction, for example a plastic, is mounted on the free, downwardly directed end of the arm 18. In the operating position of the staple magazine 8, as illustrated, the free end of the arm 19 of the lever 16 is in contact with the upper surface of the staple magazine 8, with the result that the lever 16 is pivoted into a position in which the pad element 18' is pressed onto the leading staple (not shown) located in the staple magazine 8 and adjacent to the staple output channel 30, so that this staple cannot enter the staple output channel 30. However, if the staple magazine 8 is pivoted downwardly into the above-described blocking position, the arm 19 is released from the top of the staple magazine 8, and the pad element 18' is no longer pressed into engagement with the leading staple, so that the latter can be moved in the conventional way into the staple output channel 30 as a result of spring pressure.

A projection 22 having an orifice is mounted on the topside of the staple magazine 8. A rod element 20 is fastened by means of its lower end in this orifice. For this purpose, the lower end of the rod element has an axially extending open recess and barb-like protrusions 21 which, when the lower end of the rod element 20 is inserted into the orifice in the projection 22 from above, are compressed as a result of elastic deformation and then engage behind the peripheral wall of the orifice. The lower part of the rod element 20 is surrounded by a compression spring 23 which is supported by its lower end seating on the projection 22, and by its upper end engaging under a stationary annular shoulder 24 formed in the housing. Thus, because it engages the stationary annular shoulder 24, the spring 23 exerts on the staple magazine 8 a force acting downwards, that is to say in the direction of displacement into the blocking position.

As indicated in FIG. 1, above the annular shoulder 24, the rod element 20 is guided so as to be axially displaceable in the housing and extends through a projection 25 formed on the actuator element 4. Above this projection 25, an annular rib 26 is formed on the rod element 20. The upper end of the rod element is V-shaped, and on the free leg thereof is disposed a blocking projection 27 with an oblique face 28 which, in the position shown, rests against a side face of a protrusion 29 formed in the housing. This protrusion has a lower stop surface 29' which is directed downwards, and which is located opposite an upwardly facing step 4' of the actuator element 4. The free leg of the bar element 20 having the block-projection 27 is elastically deformable. Thus, when the bar element 20 is lowered from the position shown, that is to say when the staple magazine 8 is moved into the blocking position, the blocking projection 27 moves downwardly between the stop surface 29' of the protrusion 29 and the step 4' of the actuator element 4. In this position, the blocking projection 27 prevents an upward movement of the actuator element 4, and consequently prevents actuation of the main switch 3.

To drive a staple into a workpiece with this tacker, the output end of the staple output channel 30 is placed on a workpiece. Then the tacker is pressed downwards in such a way that the staple magazine 8 is pivoted about the axle 9, against the effect of the spring 23, out of the blocking position into the operating position shown. As a result of contact between the lower end face of the bar element 20 and the upper face of the staple magazine 8, the bar element 20 is also thereby moved upwards. This causes, on the one hand, the spring 23 to be compressed and, on the other hand, the blocking projection 27, because of its upper bevelled surface, to be pivoted out of the region between the step 4' of the actuator element 4 and the stop surface 29' of the protrusion into the position shown. Thus, in the position illustrated, the actuator element 4 can be moved upwards and the coil 13' of the solenoid thereby excited by operation of the switch 3, so that the armature 13 is driven downwards and the driving element 15 drives the staple located in the staple output channel 30 into the workpiece.

An already described above, in this operating position of the magazine 8, the pad element 18' mounted on the lever 16 is engaged with the leading staple located in the staple magazine 8 and prevents it from entering the staple output channel 30. It is, therefore, possible to actuate the actuator element 4 several times and thus carry out further driving strokes on a staple already driven into the workpiece.

If a check is to be made to see whether the staple has been driven far enough into the workpiece, the actuator element 4 is retained in the raised position (i.e. depressed). In this position, the upper surface of the projection 25 of the actuator element 4 is engaged with the lower annular surface of the annular rib 26 of the rod element 20. Thus, when the tacker is lifted off from the workpiece with the actuator element raised, because of this engagement, the rod element 20 is held in the raised position shown. Thus, the staple magazine 8 also remains in its upper operating position, and the pad element 18' prevents further staple feed from the staple magazine 8. It is, therefore, possible in this state to reposition the tacker onto a staple which has not yet been driven in completely. When so replaced, the staple magazine 8 continues to be held in its upper operating position so preventing the leading staple therein from being urged into the staple output channel 30 when the actuator element 4 is released and then returned to the depressed position shown. The actuator element 4 can then be re-actuated to trigger a predetermined number of strokes, for example a single stroke, so that the driver 15 carries out a further driving stroke on the staple already partially driven in.

If the tacker is lifted off from the workpiece without the actuator element 4 being held in a raised position, the staple magazine 8 moves into the blocking position. This being due, on the one hand, because of gravity and, on the other hand, as a result of the effect of the spring 23. The rod element 20 is also moved downwards, and the blocking projection 27 passes into the space between the step 4' of the actuator element 4 and the stop surface 29' of the protrusion 29. Because of the pivoting of the staple magazine 8 into the lower blocking position, the free end of the arm 19 of the bell crank lever 16 is released from the upper surface of the staple magazine 8; thus the pad element 18' is no longer firmly engaged with the front staple in the staple magazine 8. This front staple is, therefore, conveyed into the staple output channel 30, and the tacker is ready to drive in a further staple.

Figure 2:
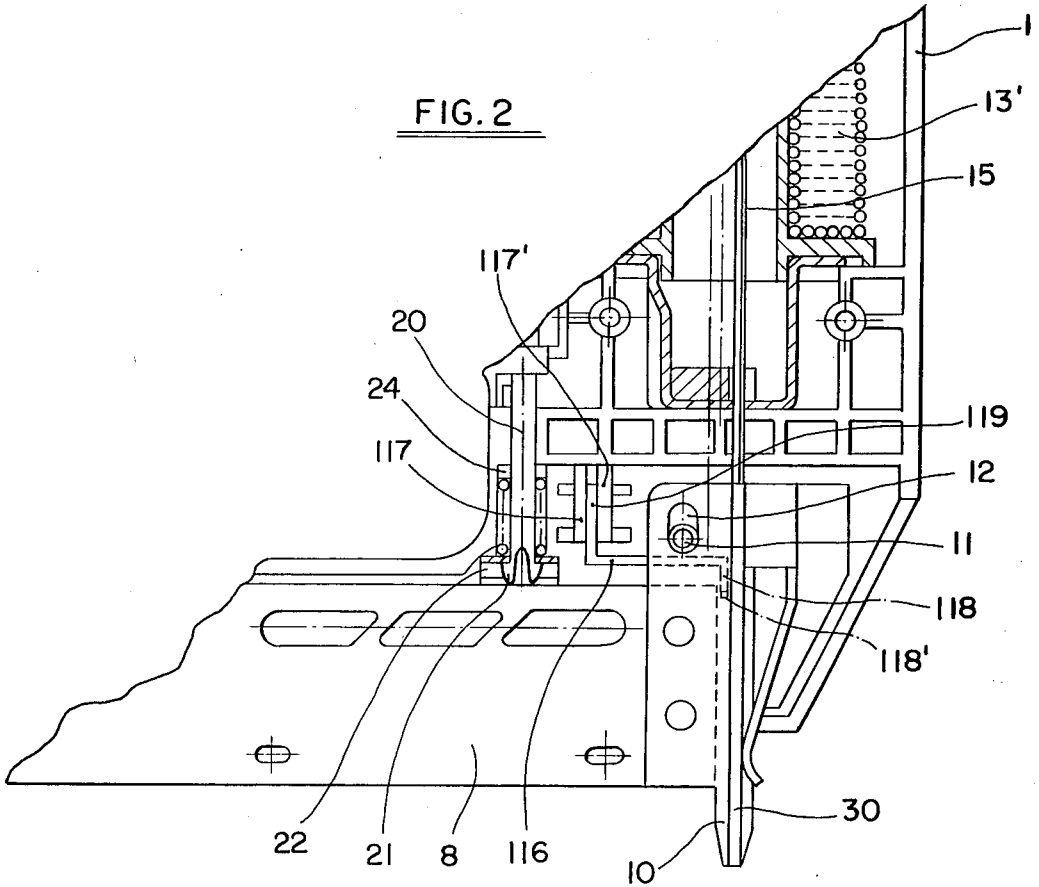
FIG. 2 shows a portion of a section, similar to FIG. 1, of a modified staple blocking means according to the invention.

FIG. 2 illustrates a staple blocking means modified in relation to the bell crank lever staple blocking arrangement of the embodiment of FIG. 1. However, the remaining details of the tacker containing the modified staple blocking means of FIG. 2 corresponds to the design of the tacker in FIG. 1.

The staple blocking means of FIG. 2 comprises a leaf spring 116 which is fastened by means of an upturned end region 119 inserted between two ribs 117, 117' formed in the housing half-shell 1. The central region of the leaf spring 116 is angled in relation to the end region 119 and, in the operating position of the staple magazine 8, extends essentially parallel to the longitudinal extension of the latter. The free end 118 of the leaf spring 116 is angled downwardly in the direction of the staple magazine 8, and carries at its extreme free end a pad element 118' corresponding to the pad element 18' of FIG. 1.

In the operating position of the magazine 8, as illustrated in FIG. 2, the pad element 118' is engaged with the staple (not shown) located in the staple magazine 8 and adjacent to the staple output channel 30, and is pressed against this staple as a result of elastic deformation of the leaf spring 116. Especially as a result of elastic deformation of the leaf-spring portion located between the vertical end regions 119 and 118, this leading staple is prevented from entering the staple output channel 30. If the staple magazine 8 is pivoted into the lower blocking position explained in connection with FIG. 1, the free end 118 of the leaf spring 116 is released from the front staple, and the leaf spring can flex back into its relaxed position. In this relaxed position of the leaf spring 116, the free end 118 moves further down than the position in FIG. 2. However, in this relaxed position, the pad element 118' is no longer in blocking engagement with the front staple in the staple magazine, so that this staple can be moved in the conventional way into the staple output channel 30 as a result of spring pressure. It is immediately clear that the next upward pivoting of the staple magazine 8 into its operating position again results in an engagement of the pad element 118' and the front staple located in the staple magazine, so that the free end 118 of the leaf spring 116 is again pivoted under elastic deformation into the position shown in FIG. 2 and prevents this leading staple from being fed into the staple output channel 30 (which in any case now has a staple therein).

The above described embodiments, of course, are not to be construed as limiting the breadth of the present invention. Modifications, and other alternative constructions, will be apparent which are within the spirit and scope of the invention as defined in the appended claims.

What is claimed is:

1. An electro-magnetic tacker, comprising:

a staple magazine mounted on a housing of the tacker and having a staple output end provided with a staple output channel;

said staple magazine being movable between a blocking position, in which said staple output end is pivoted downwardly in relation to said tacker housing, and an operating position in which said output end is pivoted upwardly into a position adjacent said tacker housing;

a coupling element located between said staple magazine and an actuator element of a main operating switch;

said coupling element being connected to said tacker magazine and being provided with an engagement portion, said engagement portion being engaged by said actuator element in an actuated position thereof to hold said staple magazine in said operating position; and staple blocking means for blocking feeding of a front staple in said staple output end of said staple magazine in said operating position of said staple magazine, and for permitting feeding of such front staple into said staple output channel in said blocking position of said staple magazine.

2. The tacker of claim 1, wherein said staple blocking means comprises a two-armed pivotably mounted lever, one end of said lever being engaged by said staple magazine in said operating position to pivot said lever so that the other end of said lever is placed in blocking engagement with said front staple.

3. The tacker of claim 2, wherein a pad element having a high coefficient of friction is mounted on said other end of said lever.

4. The tacker of claim 1, wherein said staple blocking means comprises a leaf-spring element mounted in said tacker housing with a free end of said leaf-spring element elastically deformed in said operating position of said staple magazine and in blocking engagement with said front staple.

5. The tacker of claim 4, wherein said free end of said leaf-spring element is bent.

6. The tacker of claim 5, wherein a pad element having a high coefficient of friction is mounted on said free end of said leaf-spring element.

7. The tacker of claim 1, wherein said coupling element comprises a bar element having an annular shoulder forming said engagement portion, and said actuator element is provided with a projection located between said staple magazine and said annular shoulder, said projection being engageable with said annular shoulder.

8. The tacker of claim 7, wherein said bar element is provided with an elastically movable blocking projection at its end remote from said staple magazine, said blocking projection being in blocking engagement with a stationary stop surface in said blocking position of said staple magazine and blocking said actuator element against movement, and said blocking projection being flexed away from said stop surface in said operating position of said staple magazine.

9. The tacker of claim 1, wherein said staple magazine is movable against spring force from said blocking position to said operating position.

10. An electro-magnetic tacker, comprising:

a housing;

a main switch in said housing for causing, when actuated, staple driving strokes of the tacker to be carried out;

an actuator element connected to said main switch for actuation thereof, said actuator element being manually actuated;

a staple magazine pivoted to and below said housing and having a staple output end provided with a staple output channel;

said staple magazine being pivotal between a blocking position, in which said staple output channel is spaced away from said housing, and an operation position in which said staple output channel is adjacent said housing and in communication therewith;

a coupling bar connected at one end to said magazine and having an engagement portion at its other end, said engagement portion being engaged by said actuator element when actuated to hold said magazine in said operating position; and a staple blocking member mounted on said housing above and adjacent said staple output end, said staple blocking member having an arm with a downturned end, said end engaging a front staple in said magazine when in said operating position to block feeding of said front staple, and said end releasing said front staple to permit feeding thereof into said staple output channel when said magazine is pivoted to said blocking position.

11. The electro-magnetic tacker of claim 10, wherein said staple blocking member comprises a leaf-spring having one end secured in said housing, and having its other end free and including said downturned end, said leaf-spring being resiliently deformed with said downturned end displaced upwardly in said operating position of said magazine.

12. The electro-magnetic tacker of claim 10, wherein said magazine and said staple blocking member are pivotal about parallel axes, and said staple blocking member comprises a bell crank lever both arms of which are bent downwardly adjacent the free ends thereof.

13. An electro-magnetic tacker, comprising:

a housing;

a manually operable actuator member movable mounted in said housing for actuation of said tacker;

a staple magazine pivoted adjacent one end to said housing and communicating with a staple output channel at the other end;

said staple magazine being pivotal between a blocking position, in which said staple output channel is spaced away from said housing, and an operation position in which said staple output channel is in operative communication with said housing;

staple blocking means for blocking feeding of a front staple in said magazine into said staple output channel when said magazine is in said operation position, and for permitting such feeding when said magazine is in said blocking position;

an elongate coupling bar connected at one end to said magazine for movement therewith, and having a resiliently deformable hook at its other end, said hook being formed with an enlargement having engagement faces;

a shoulder formed on said coupling bar intermediate the ends thereof;

a projection extending from said actuator member and located between said magazine and said shoulder, said projection being engaged by said shoulder when said actuator member is actuated and then holding said magazine in said operating position while said actuator member is held in an actuated position; and a stationary stop surface in said housing, said enlargement of said hook engaging said stop surface in said blocking position of said magazine to block said actuator member against actuation, said enlargement flexing away from said stop surface when said magazine is pivoted to said operating position.

14. The electro-magnetic tacker of claim 13, further comprising a compression spring compressed between said housing and said magazine, and surrounding a portion of said coupling bar adjacent said magazine.

15. The electro-magnetic tacker of claim 13, wherein said one end of said coupling bar is provided with barb-like protrusions which are inserted in a hollow projection on said magazine and engage behind a wall of said hollow projection.

* * * * *